United States Patent [19]

Helwig, Jr.

[11] 4,315,140

[45] Feb. 9, 1982

[54] ENERGY SAVING DISHWASHER

[75] Inventor: William F. Helwig, Jr., Downers Grove, Ill.

[73] Assignee: Avtec Industries, Inc., Downers Grove, Ill.

[21] Appl. No.: 173,770

[22] Filed: Jul. 30, 1980

Related U.S. Application Data

[63] Continuation-in-part of Ser. No. 77,135, Sep. 19, 1979, Pat. No. 4,254,788.

[51] Int. Cl.[3] ..... H05B 1/02

[52] U.S. Cl. ..... 219/486; 219/483; 219/321; 219/327; 219/337; 134/56 D; 134/57 D; 307/38; 307/39

[58] Field of Search ..... 219/483, 486, 321, 327, 219/329, 335, 334, 328, 485; 134/56 D, 57 D, 58 D, 105, 107; 307/39-41

[56] References Cited

U.S. PATENT DOCUMENTS

| | | | |
|---|---|---|---|
| 3,173,432 | 3/1965 | Dronberger | 219/321 |
| 3,635,229 | 1/1972 | Jacobs | 219/321 |
| 3,890,987 | 6/1975 | Marcussen et al. | 134/57 D |
| 4,068,179 | 1/1978 | Sample et al. | 134/57 D |
| 4,104,668 | 8/1978 | Laar | 219/321 |
| 4,138,607 | 2/1979 | Engelmann | 219/497 |

*Primary Examiner*—B. A. Reynolds
*Assistant Examiner*—M. Paschall
*Attorney, Agent, or Firm*—Edward D. Gilhooly

[57] ABSTRACT

A control circuit for a dishwashing machine to economize its energy consumption and usage. In order to conserve energy, the dishwashing machine has a control system for automatically actuating the components such as the heating elements of the dishwashing machine. The control system can easily be adapted for utilization with many types of existing dishwashing machines, thereby permitting coupling of the control system with commercially available equipment with minimum installation and alteration of machine components.

7 Claims, 2 Drawing Figures

412
701
A
START
B
411
C
700
D
400
405
404
406
407
410
401
402
403
E
413
F
S
T
G
414
H
500
I
801
501
J
502
K
802
L
800
600
M
803
601
803a
N
602
O
603
P
604
604b
630
Q
604a
804
R
640
620
621
X
430
Y

ENERGY SAVING DISHWASHER

This applicaton is a continuation-in-part of co-pending application, Ser. No. 077,135 and filed Sept. 19, 1979, now U.S. Pat. No. 4,254,788.

BACKGROUND OF THE INVENTION

This invention relates in general to a dishwashing machine and, in particular, to a control system for automatically actuating the operating components of a dishwashing machine such as dishwasher pumps, conveyor motor, exhaust fan motor, booster heaters, tank heaters and the like.

More specifically, this invention relates to dishwashing machine control systems whereby the energy consumption of a dishwashing machine is reduced by controlling the operation of the various operating components of the machine. Furthermore, the control systems can readily be adapted to utilization with many types of existing dishwashing machines, thereby permitting coupling of the control system of the invention with commercially available equipment with minimum installation and alternation of machine components.

Commercial dishwashing machines, such as are widely used in restaurants, generally involve a plurality of operator initiated steps such as, for example, closing drain valves; opening fill valves; filling tanks to the proper levels; actuating tank and booster heaters and so forth. Generally, prior art commercial dishwashing machines must be operated for sustained periods of time with considerable waste of electrical energy.

Due to the fact that it is both time-consuming and inefficient to continually turn the machine on and off as use is desired, the dishwashing machine is commonly turned on in the morning and remains in continuous operation until the last dishwashing operation is completed. Since the dishwashing machine is only used intermittently during the course of the day, there are times during the day when the machine is energized and not in use. During this time, the heating elements are actuated to maintain the temperature of the water at a desired level to provide sufficient hot water for the various cycles of the dishwashing machine. Also, various other components of the dishwashing machine such as the conveyor dishwasher motor, pumps and exhaust fan motor also remain electrically actuated. Because of the continuous operation of these heaters and various other components, the dishwashing machine needlessly consumes electrical energy increasing the cost of its operation and being counter-productive to the national objective of energy conservation.

In order to accomplish an effective and efficient washing operation, hot water is generally dispensed in prior art dishwashing machines onto the dishes during a pre-wash cycle which occurs as soiled dishes enter the machine. Such known dishwashing machines often have tank heaters which heat water for use during the pre-wash and final rinse cycle of the dishwashing machine. However, the tank heaters require actuation before any dishes enter the machine, because the water must be sufficiently hot to pre-wash the dishes as they enter the machine thereby requiring the tank heater to be on and ready all the time. Dishwashing machines in the prior art also have booster heaters which provide additional hot water, if necessary, to the tank heaters for the final rinse cycle. These booster heaters require costly energization as soon as the washing cycle was commenced to provide additional heated water, if necessary, for the final rinse cycle.

In previous dishwashing machines, the on-off cycle of these heaters was independent of the washing and rinsing operations of the dishwashing machine, thereby both the booster heater and the tank heaters had to be continually energized to insure that the machine always had a sufficient supply of hot water as it was needed.

Such simultaneous operation of both heating elements, the booster heater and the tank heater, results in a costly increase in the kilowatt hour and energy demand required by the dishwashing machine.

SUMMARY OF THE INVENTION

It is, therefore, an object of this invention to improve dishwashing machines.

Another object of this invention is to utilize a control system for automatically actuating components of a dishwashing machine.

A further object of this invention is to conserve energy by reducing the operating time of the dishwashing machine and heating elements.

Still another object of this invention is to prevent simultaneous operation of the heating elements.

Another object of this invention is to render the heating elements dependent on machine operation.

Still another object of this invention is to actuate the heating elements in a sequential order of the machine operation.

A further object of the present invention is to provide a control system that can easily be adapted to an existing dishwashing machine.

These and other objects of the invention are attained in accordance with the present invention wherein there is provided a control circuit to minimize the energy consumption of a dishwashing machine.

The control circuit of the present invention prevents both heater elements from operating simultaneously thereby resulting in a favorable reduction of KWH and energy demand required by the system, thereby reducing the utility dollar.

The control circuit of the dishwashing machine causes the tank heaters to be actuated when the machine is turned on to remain in a heated state until soiled dishes enter the machine whereby some of the water heated by the tank heater is dispensed for pre-washing. The tank heater then is deactivated, because the water in the tank heater is sufficiently hot for use during the other rinse cycles. As the dishes enter the machine such as on a rack moved by a conveyor, the booster heaters are energized to provide additional hot water, if necessary, to the already hot water existing in the tank heater, thereby insuring that a sufficient amount of hot water is present in the tank heater for both the pre-wash and final rinse. When the rack of dishes reaches the final rinse cycle, hot water is dispensed providing the required hot water for the final rinse of the rack of soiled dishes. The rack will then exit the machine thereby turning the booster heaters off and turning the tank heater back on thus rendering the machine ready for another rack to enter.

The foregoing operation effected by the control circuit of the application results in significant energy conservation as compared to prior art devices.

BRIEF DESCRIPTION OF THE DRAWINGS

These and other objects and advantages of the embodiments of the present invention will become more fully apparent from the following detailed description when read in conjunction with the accompanying drawings wherein.

DESCRIPTION OF A PREFERRED EMBODIMENT OF THE INVENTION

Figure 1:
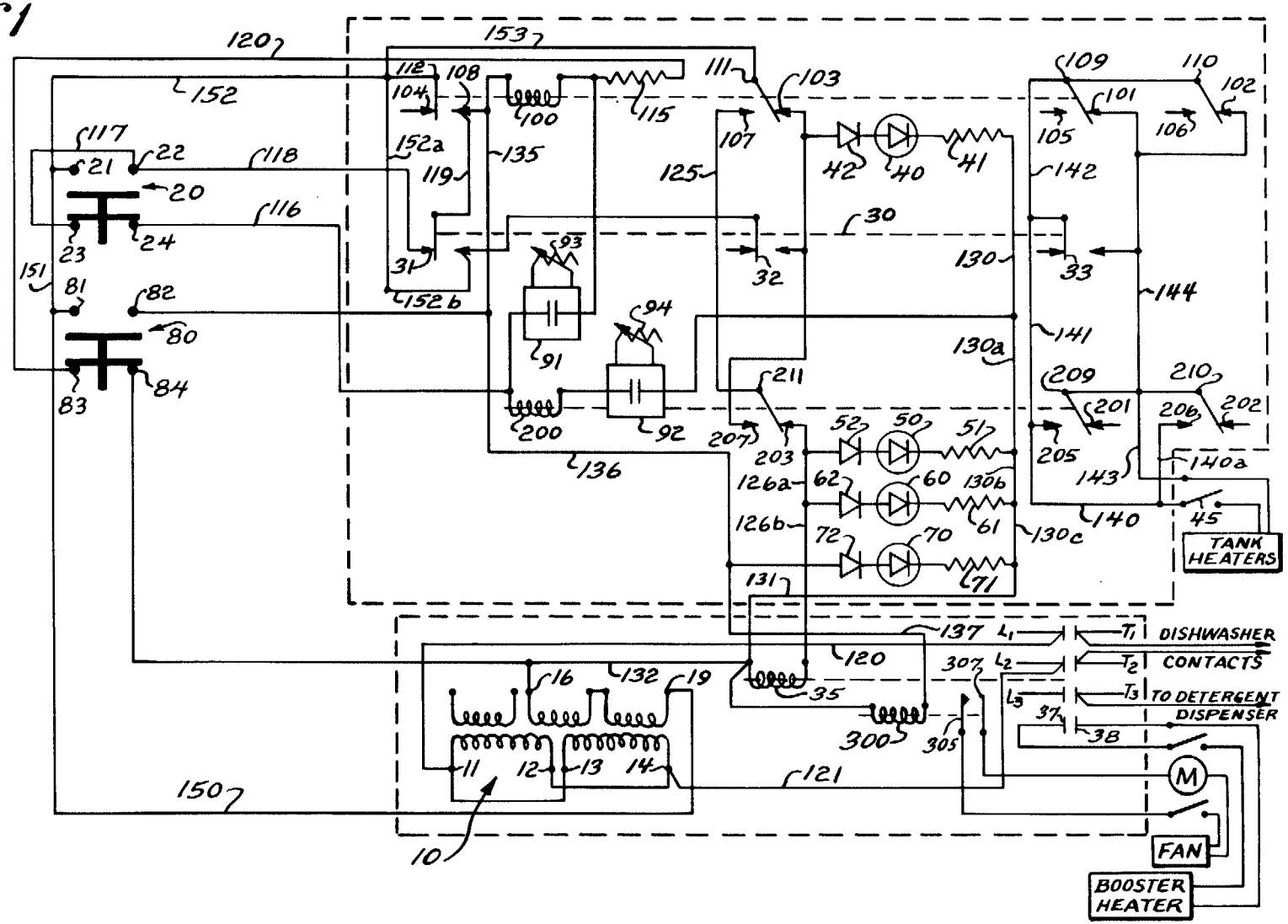
FIG. 1 is a schematic diagram of a 1st embodiment electrical control system for a dishwashing machine to control the energy demand and usage of the machine.

Referring to FIG. 1, there is shown a suitable control circuit for a dishwashing machine to facilitate control of energy during operation of the machine. Although the circuit of the invention is described for convenience of illustration with use in a rack conveyor dishwashing machine, the invention is not intended to be so limited and may be used with other types of dishwashing machines where economy of operation is desired. Lines $L_1$, $L_2$ and $L_3$ shown in the figure are electrical power lines connected to a suitable source of electrical power (not shown) to operate the components of a dishwashing machine such as, for example, a rack conveyor dishwashing machine.

Before racks containing soiled dishes are inserted into a dishwashing machine controlled by the circuit of the present invention, a main power switch (not shown) is turned to the on position to commence operation of the dishwashing machine, and a by-pass switch 30 is put into the automatic mode where by-pass switch contacts 31, 32 and 33 are in the position as illustrated in FIG. 1. Independently, a tank heater thermostat switch 45, a booster heater thermostat switch 65 and a fan motor switch 75 are also actuated. The rack conveyor dishwashing machine has tank heaters which are coupled to the control circuit where indicated in FIG. 1 and are energized when the tank heater thermostat switch 45 is closed thereby allowing electrical current to pass through electrical leads 140–141–142 into normally closed contact 109–101 and 110–102 through leads 144–143 and back to the tank heaters. The tank heaters function to maintain water temperature at a desired level to provide hot water for both pre-washing and the final rinse of the rack of soiled dishes. It is essential that the tank heaters are started when the main power switch is actually turned on, so that the water will be sufficiently heated when the rack containing soiled dishes enters the machine to be pre-washed.

A tank heater indicator 40 is energized when the main power switch is activated to evidence the fact that the tank heaters are operating. Electrical current flows into the previously mentioned main power switch through Lines $L_1$ and $L_2$ and then passes to a multi-turn voltage transformer 10 through leads 120 and 121, respectively. The current through lead 120 is directed to contacts 11 and 13 of voltage transfomer 10, and the current through lead 121 is coupled to contacts 12 and 14 of the voltage transformer 10 which steps down voltage. The current then flows out of the voltage transfomer 10 at contact 19 and passes through lead connections 150–151–152–153 and then through normally closed contacts 111–103, a blocking diode 42 and a resistor 41 thereby driving the tank heater indicator 40 which is a light emitting diode (LED). The LED is displayed on a control box (not shown) for visual inspection by the operator. The current returns through the lead connections **130–130*a*–130*b*–130*c*–131–132 back to the voltage transformer 10 at contact 16**.

In order to commence the cycle of operation of a dishwashing machine, a rack containing soiled dishes is inserted into the machine. Upon the insertion of the rack into the dishwashing machine, a start switch 20 which is mounted on a soiled dishtable (not shown) at the entrance of the dishwashing machine, is actuated thereby opening normally closed contacts 23–24 and closing normally open contacts 21–22. The current now flows out of the voltage transformer at contact 19, through the leads 150–151, into the start switch 20 and through contacts 21–22 and then through lead 118 to the by-pass switch contacts 31 and proceeding through lead 119 to thereby energize a relay 100. The current returns through a limiting resistor 115, through lead 120 to normally closed contacts 83–84 of a table limit switch 80 and back to contact 16 of the voltage transformer 10. Since the water temperature maintained by the tank heaters is at the desired temperature level, the tank heaters are no longer needed, whereby some of the heated water is dispensed as the rack of soiled dishes enters the dishwashing machine to pre-wash the rack of soiled dishes for more effective washing of the dishes.

When relay 100 is energized, normally open contacts 110–106 and normally open contacts 109–105 are closed thereby turning off the tank heaters. Normally, open contacts 111–107 are now also closed thereby de-energizing the tank heater indicator 40.

The tank heaters remain off during the time that the rack of soiled dishes passes through the machine in a washing operation thereby conserving considerable amounts of energy.

After totally energizing, relay 100 latches through its own normally open contacts 112–108 which have not closed. The current that formerly drove the tank heater indicator 40 now flows through closed contacts 111–107, through lead 125, through normally closed contacts 211 and 203, through lead connections **126*a*–126*b* to a relay 35 which is thereby energized closing the contacts and starting the dishwashing machine, the pumps, the conveyor and the detergent dispenser transformer. The current then returns through lead 132 to contact 16 of the voltage transformer 10. A dishwashing machine indicator 50 also receives current through contacts 111–107, through lead 125 and normally closed contacts 211 and 203, and then through a blocking diode 52 and a limiting resistor 51 thereby driving the dishwasher indicator 50, which is an LED. This LED is also displayed on the control box for visual inspection by the operator. The current then returns through leads 130*b*–130*c*–131–132 to contact 16 of the voltage transformer 10**.

Booster heaters are energized through the normally open contacts 37–38 which were closed when relay 35 was energized and the booster heater switch 65 which was turned on when the main power switch was activated. The booster heaters inject additional hot water, if necessary, to the tank heater so that hot water will be available for the final rinse spray when the rack of soiled dishes reaches the final rinse cycle. Thus, as the rack of soiled dishes enters the machine, and relay 100 is energized thereby energizing relay 35, the booster heaters will start up and supply additional hot water, if necessary, to the tank heater for the final rinse. The booster heaters will only operate when the rack of soiled dishes is in the machine, and it will automatically turn off as the rack of soiled dishes exits the machine.

Effectively, the booster heaters and the tank heaters will never operate simultaneously thereby conserving considerable amounts of energy. A booster indicator 60 also receives current from contact 111-107, through lead 125, through contacts 211-203, through a blocking diode 62 and a limiting resistor 61 thereby driving booster heater indicator 60, which is an LED displayed on the control box for visual inspection by the operator. The current then returns through lead connections 130c-131-132 to contact 16 of the voltage transformer 10.

Since normally open contacts 112 and 108 are now closed, the current flows through those contacts and then through lead connections 135-136-137 to a relay 300 thereby energizing it. When relay 300 is energized, normally open contacts 305-307 are now closed thereby energizing a fan motor, since fan motor switch 75 was closed when the main power switch was turned on. A fan indicator 70 is also turned on through contacts 112-108, leads 135-136 and then through a blocking diode 72 and a limiting resistor 71 thereby driving fan indicator 70, which is also an LED displayed on the control box for visual inspection by the operator. The current returns through leads 131-132 to contact 16 of the voltage transformer 10.

The rinse injector and solenoid are supplying power to dishwashing machine contacts $T_1$ and $T_2$ which are now energized when relay 35 was energized and are turned on through their own control circuitry.

After the rack containing the soiled dishes clears the start switch, the start switch 20 automatically resets, and contacts 21-22 open and contacts 23-24 now close. However, all energized components remain energized, since relay 100 remains latched. The current in lines 150-151-152 now goes through contacts 112-108, through lead 119, and passes through by-pass switch 31. The current continues to flow through lead connections 118-119, and pases through now closed contacts 23-24 of the start switch 20, and then goes through line 116 to a relay 200 supplying power to a timer 92, which begins the delay to close the timing contacts of timer 92. The length of the delay of timer 92 is dependent on the setting of a potentiometer 92 associated with timer 92. The length of the delay is usually the time to allow the rack to exit the dishwashing machine.

At a time just prior to the end of the delay of timer 92, a final rinse solenoid is energized thereby dispensing the water heated by the tank heater and supplemented by the booster heater for the final rinse spray just as the rack of soiled dishes is nearing the end of the rinsing operation of the dishwashing machine. After the delay elapses, the contacts of timer 92 close, whereby relay 200 is energized.

The rack has now exited the machine, so the need for the operation of various heaters has ceased. Thus, when relay 200 is energized, normally closed contacts 211-203 swing to the open position thereby turning off the dishwasher contactor, pumps conveyor, detergent dispenser, dishwasher indicator 50, booster heater and booster indicator 60.

The tank heaters are turned on, when relay 200 is energized, as normally open contacts 205-209 and normally open contacts 210-206 are also closed. The current now flows through leads 140 and 140a, through contacts 205-209-206-210, respectively, and then unites to flow through lead 143 to the tank heaters.

The tank heater indicator 40 is also again turned on to show that the tank heaters are on. The current flows through contacts 111-107, through lead 125, through contacts 211-207, through lead 124 to a blocking diode 42 and limiting resistor 41 thereby driving the tank heater indicator 40. The current then returns through lines 130-130a-130c-131-132 to contact 16 of the voltage transformer 10. The current that was provided to timer 92 was also provided to timer 91 through lead 116 and thus, timer 91 began timing at the same time as timer 92.

There is, however, a need for the fan to remain energized for a short period after the other components are turned off to insure that all the condensation is removed from the dishes. The extra delay is provided for by a timer 91 as a potentiometer 93 is set for a longer delay than the potentiometer 94 of timer 92. When the contacts of timer 92 close, thereby energizing relay 200 and turning the various components of the dishwashing machine off, the fan and the fan indicator remain energized as they receive their power through relay 300 which has remained energized. Thus, the contacts of timer 91 will close at a time subsequent to the time when the contacts of timer 92 close. After the contacts of delay timer 91 close, relay 100 will short out. The current through timer 91 is limited through resistor 115 and, therefore relay 100 de-energizes. When relay 100 de-energizes, normally open contacts 112-108 will open thereby shutting off power to all relays and timers and returning the circuits to the stand-by mode. The tank heaters and tank heater indicator 40 remain on, and the dishwashing machine is ready for another rack to enter it.

The dishwashing machine also has the table limit switch 80, which is mounted on the clean dishtable (not shown), to de-energize all dishwasher motors, detergent dispenser, final rinse solenoid, rinse injector and booster heater in the event of a rack backup into the dishwashing machine opening. The table limit switch 80 can be actuated during any part of the cycle. When actuated, normally open contacts 81-82 will close, and normally closed contacts 83-84 will open thereby providing power to relay 300. The current flows from the table limit switch 80 through leads 135-136 to the fan indicator 70 and also through lead 137 thereby energizing relay 300 to close the normally open contacts 305-307 to start the fan. When normally closed contacts 83-84 of table limit switch 80 are open, relay 100 is turned off thereby de-energizing all other components. When the table limit switch 80 is released, the contacts 83-84 close whereby the relay 300 loses power, and the fan operation ceases. However, when the table limit switch 80 is activated, in order to have the dishwashing machine ready to restart, the start switch 20 must be manually operated to begin operation of the dishwashing machine.

During certain peak periods of operation, it is both desirable and more efficient for the dishwashing machine and its various components to be in continual operation. The dishwashing machine has a by-pass switch 30 to provide for the continual operation.

When continual operation is desired, the by-pass switch 30 is turned to the manual position thereby closing the normally open by-pass switch contacts 31, 32 and 33. The current that flows through the by-pass switch contacts 31 energizes relays 100 and 300 and disconnects relay 200 and timers 91 and 92 thereby allowing the dishwasher contactor, conveyor pumps, booster heater, detergent dispenser, fan, dishwasher indicator 50, water indicator 60 and fan indicator 70 to remain on. The by-pass switch contacts 32 turn the tank heater indicator 40 on while the by-pass switch contacts 33 turn the tank heaters on. Upon activation of the table limit switch 80 at any time during this by-pass operation, all functions are de-activated except the tank heater and the fan. However, all functions of the dishwashing machine are re-activated when the table limit switch 80 is released.

DESCRIPTION OF A PREFERRED ALTERNATIVE EMBODIMENT

Figure 2:
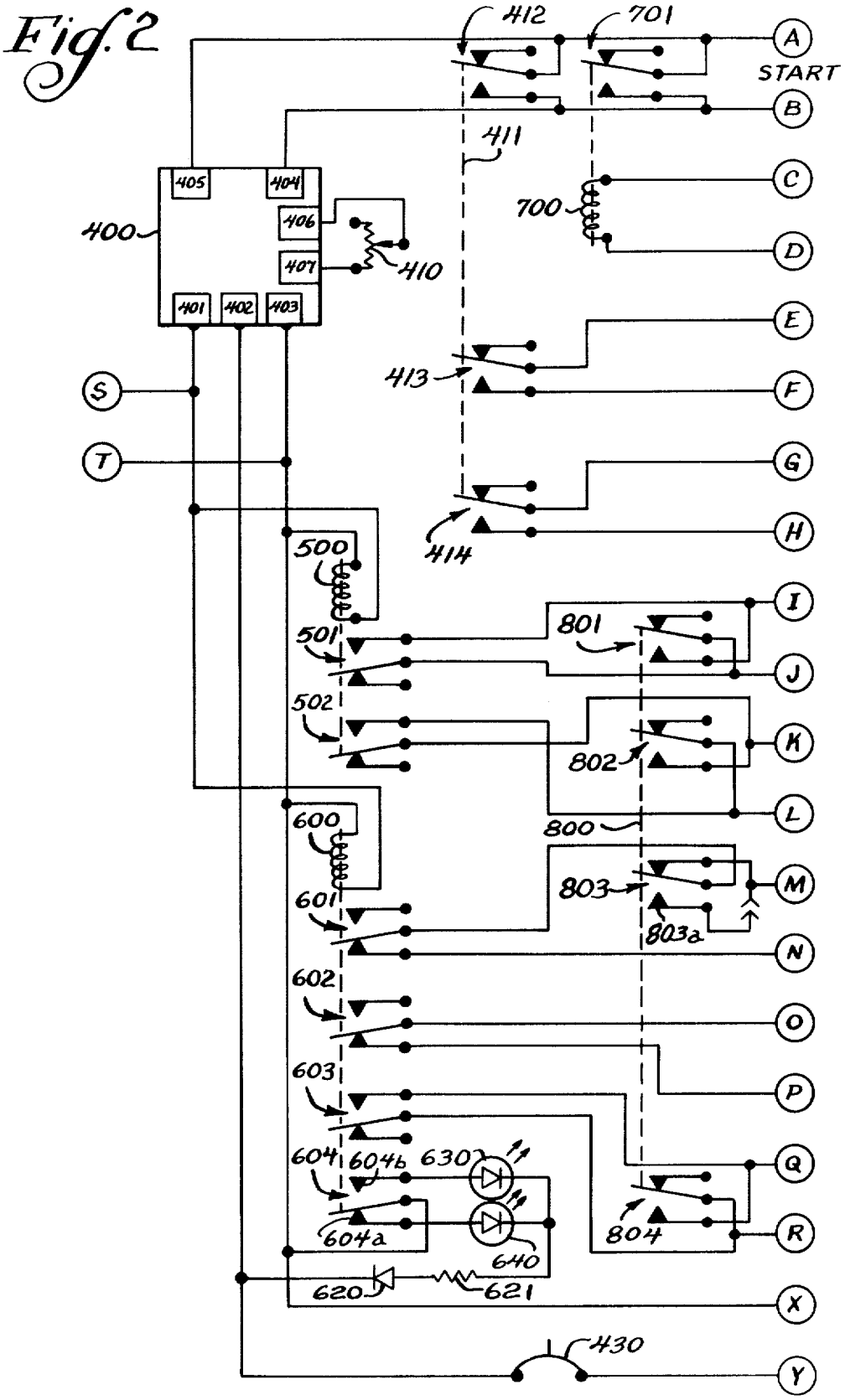
FIG. 2 is an alternative schematic diagram for an electrical control system for a dishwashing machine to control energy demand and usage of the machine.

Referring to FIG. 2 there is shown a schematic diagram depicting an alternative embodiment of the control circuit for a dishwashing machine to facilitate the control of the energy consumption and usage of the dishwashing machine during its operation. Although the circuit of the invention is described for purposes of illustration utilizing the following terminal connections shown below, the invention is not intended to be so limited:

| | |
|---|---|
| A, B- | remote start switch |
| C, D- | final rinse solenoid |
| E, F & G, H- | start function for the dish machine i.e. - conveyor, pumps, detergent dispenser |
| I, J & K, L- | stop functions of the dish machine |
| M, N- | start function for tank heaters |
| O, P- | stop function for tank heaters |
| Q, R- | booster heater connection |
| S, T- | hour meter (optional) |
| X, Y- | power supply |

The circuit may be used in connection with other types of dishwashing machines which are not equipped with elements to be connected to the various terminal connection listed above. In that event the unused terminals are merely left open and unconnected.

For convenience of illustration the circuit of the present invention will be disclosed in use in a rack conveyor dishwashing machine. However, the invention is not intended to be so limited and may be used in other types of dishwashing machines.

Before a rack containing soiled dishes is inserted into the dishwashing machine controlled by the circuit of the present invention, a main power switch (not shown) is turned to the on position to commerce operation of the dishwashing machine, and the by-pass switch 800 is put into the automatic mode whereby the contacts associated with by-pass switch 800 are positioned as illustrated in FIG. 2. Lines X and Y provide power to the control circuit shown in FIG. 2 and are connected to a suitable source of electrical power (not shown) to operate the components of a dishwashing machine such as, for example, a rack conveyor dishwashing machine. A manual circuit breaker 430 is provided in the power line Y for disabling of the control circuit, if desired. S When the machine is initially turned on, the tank heater which is connected to output terminals M, N is independently energized so that the dishwashing machine will have sufficient hot water available for use in the pre-washing of the rack of soiled dishes. Upon independent energization of the tank heaters, on LED 640 is energized through switch contact 604, limiting resistor 621 and diode 620 to visually indicate to the machine operator that the tank heaters are then operating.

The dish machine cycle begins when start switch 411, which has switch contacts 412, 413 and 414 associated therewith, is actuated. In the event that control circuit is installed at a location that is not easily accessible to the machine operator, a remote start switch (not shown) can be utilized and placed at a location in close proximity to the entry of the dishwashing machine. The remote start switch can be connected to output terminals A and B of the control circuit and will function in the same manner as start switch 411. Upon activation of the start switch 411 normally open switch contacts 412, 413 and 414 are closed. The closure of switch contacts 413 and 414 will allow the flow of current through output terminals E, F and G, H to energize the dish machine functions such as the conveyor, pumps, the detergent dispenser, etc. The closure of switch contact 412 will allow the current flow through contacts 404 and 405 thereby energizing timer circuit 400. Current will then flow out of terminal 401 of the timer circuit 400 to energize relays 500 and 600.

Upon energization of relays 500 and 600 normally open switch contacts 501 and 502 will close, normally closed switch contacts 601 and 602 will open and normally open switch contacts 603 will close. Additionally, switch contact 604 which was connected to terminal **604*a* will now be connected to terminal 604*b*. The opening of switch contacts 601 and 602 will deactivate the tank heaters, which are connected through terminals M, N and O, P. The closure of switch contact 603 will energize the booster heaters which are connected to terminals Q, R. When switch contact 604 contacts terminal 604*b*, LED 630** will thereby be energized to visually indicate to the machine operator that the booster heaters are operating.

The timer circuit 400 has a potentiometer 410, connected through terminals 406 and 407, which can be set for a length of time between five (5) seconds and four (4) minutes. The potentiometer 410 is usually set for a period of time that is equal to the time it takes for a rack of soiled dishes to reach the final rinse cycle of the dishwashing machine.

When the rack of dishes reaches the final rinse cycle, the final rinse solenoid (not shown) is energized to dispense hot water for the final rinse of the dishes. At this time, the timer circuit will de-energize, because the time period set by the potentiometer 41° has elapsed. Simultaneously, upon the activation of the final rinse solenoid, which is connected to terminals C, D recycle relay 700 is energized thereby closing normally open switch contact 701. The closure of switch contact 701 will reset the potentiometer 411 for the pre-set period thereby maintaining the operation of the machine. After the final rinse solenoid is de-activated, the relay 700 de-energizes and switch contact 701 will return to its normally open state. However the machine remains ready and waiting for another rack of soiled dishes.

If another rack of soiled dishes is placed into the dishwashing machine during the pre-set time period, the machine will remain on and continue in its dishwashing operation. When the rack of dishes reaches the final rinse, the final rinse solenoid will again energize recycle relay 700. Normally open switch contact 701 will close and the timer circuit 400 will be re-set for the pre-set time period, thus, rendering the machine ready for another rack of soiled dishes.

However, in the event that another rack of soiled dishes is not placed in the dishwashing machine during the pre-set time period. Relays 500 and 600 will de-energize thereby returning switch contacts 501, 502, and 601-604 to its normal positions. Thus, the tank heaters and tank heater indicator 640 will again be energized and the booster heater and the various machine functions will be de-energized.

An additional feature of the control circuit is an hour meter 450 which can be connected to output terminals S, T which are connected to terminals 401 (power) and 403 (ground) respectively. The hour meter 450 is utilized to indicate the amount of actual run time of the dishwashing machine. p In the event of the failure of the timer circuit 400 or any of the relays 500, 600 or 700 within the control circuit, a by-pass switch 800 is provided. By manually switching by-pass switch 800 into by-pass mode normally open switch contacts 801, 802 and 804 are closed and switch contact 803 moves to a position contacting terminal 803*a*. This will allow continued operation of the dish machine and all of its functions including the booster heater and tank heater until such time as the control circuit can be repaired or replaced.

While the invention has been described with reference to preferred embodiments, it will be understood by those skilled in the art that various changes may be made and equivalents may be substituted for elements thereof without departing from the scope of the invention. In addition, many modifications may be made to adapted a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. A control circuit for conserving electrical energy in a dishwashing machine comprising control means for automatically actuating various components during the operation of the dishwashing machine including at least one booster heater and one tank heater, said control means being coupled to a source of electrical power and preventing simultaneous operation of the booster heater and tank heater of the dishwashing machine, said control means further including connector means to couple the tank heater and booster heater to an electrical power source to supply power thereto, said control means further including actuator means being responsive to the commencement of a cycle of operation of the dishwashing machine to simultaneously interrupt the power directed to the tank heater and supply power to the booster heater;

delay means operatively coupled to said actuator means and the tank and booster heaters to interrupt power directed to the booster heater and supply power to the tank heater in a predetermined time interval after the actuator means senses the presence of the commencement of the cycle of operation of the dishwashing machine; and a plurality of contacts adaptable to be coupled to the operative input of various types of dishwashing machines, said plurality of contacts being electrically coupled to said control means including at least one of said contacts being electrically connected to said connector means for supplying electrical power of the dishwashing machine, at least another one of said contacts being connected to said actuator means to simultaneously interrupt the power directed to the tank heater and supply power to the booster heater of the dishwashing machine, and at least another one of said contacts being connected to said delay means to interrupt the power directed to the booster heater and supply power to the tank heater of the dishwashing machine in said predetermined time interval.

2. The control circuit of claim 1 wherein the control means further includes relay means operatively coupled between the actuator means and the tank heaters and the booster heater whereby upon actuation of the actuator means, the tank heaters will be de-energized and the booster heaters will be energized.

3. The control circuit of claim 2 further including second relay means for activating the actuator means after one portion of said pre-determined time interval for maintaining the energization of the booster heater and the de-energization of the tank heater.

4. The control circuit of claim 3 wherein said relay means energizes the tank heater and de-energizes the booster heaters after the remaining portion of said predetermined time interval unless the actuator means is re-activated.

5. The control circuit of claim 4 wherein said one portion of said pre-determined time interval is approximately equal to the duration of one complete operative cycle of the dishwashing machine.

6. The control circuit of claim 1 further including indicating means coupled to said relay means to provide one or more outputs indicative of the operation of the various functions of the machine.

7. The control circuit of claim 6 wherein said indicating means includes a light emitting diode.

* * * * *